US008716581B1

(12) United States Patent
Boyd

(10) Patent No.: US 8,716,581 B1
(45) Date of Patent: May 6, 2014

(54) STRINGED MUSICAL INSTRUMENT PICK HOLDER

(76) Inventor: Hermon Alan Boyd, Red Oak, TX (US)

( * ) Notice: Subject to any disclaimer, the term of this patent is extended or adjusted under 35 U.S.C. 154(b) by 216 days.

(21) Appl. No.: 13/366,314

(22) Filed: Feb. 4, 2012

(51) Int. Cl.
*G10D 3/16* (2006.01)

(52) U.S. Cl.
USPC ..... 84/329

(58) Field of Classification Search
USPC ..... 84/320–322
See application file for complete search history.

(56) References Cited

U.S. PATENT DOCUMENTS

| | | | | |
|---|---|---|---|---|
| 3,752,029 | A | | 8/1973 | Watrous |
| 4,467,693 | A | | 8/1984 | Nasfell |
| 4,785,708 | A | | 11/1988 | Vaughan |
| 4,890,531 | A | * | 1/1990 | Tischer ..... 84/329 |
| D309,674 | S | | 8/1990 | Gervase |
| 5,299,485 | A | | 4/1994 | Denton |
| D355,667 | S | | 2/1995 | Burger |
| 5,649,634 | A | | 7/1997 | Irizarry |
| 5,651,468 | A | | 7/1997 | Irizarry |
| D393,362 | S | | 4/1998 | Byers |
| 5,796,021 | A | | 8/1998 | Longshore |
| 6,140,564 | A | | 10/2000 | Pia |
| 6,215,052 | B1 | | 4/2001 | Giddens |
| 6,639,136 | B1 | | 10/2003 | Judd |
| 7,629,522 | B1 | | 12/2009 | Isaacson |
| 7,847,171 | B1 | | 12/2010 | Kidd, III |
| 8,097,799 | B2 | | 1/2012 | Tran |

* cited by examiner

*Primary Examiner* — Kimberly Lockett

(57) ABSTRACT

An improved pick holder device made from a single length of memory retentive material and having a helical coil (20) and u-shaped arm assemblies (30) with cleats (24) provides convenient insertion, retention, extraction, and storage of a plurality of variously sized stringed musical instrument picks (25). Removable attachment to an unmodified musical instrument strap (26) or microphone stand (33) is both firm and non-damaging. Pick holder manufacturing is accomplished on standard equipment using no special tooling.

14 Claims, 11 Drawing Sheets

STRINGED MUSICAL INSTRUMENT PICK HOLDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to stringed musical instrument peripheral equipment, specifically to a device that releasably holds picks and detachably grips a musical instrument strap or a microphone stand.

2. Prior Art

Picks are used to pluck the strings of musical instruments. Due to small size and flatness, they are easily lost or misplaced during periods when not being used. The result is either pick replacement or time spent in finding the small article. During performance, searching for a pick distracts from the purpose of the event.

Musicians often insert the pick in the musical instrument's strings such that adjoining strings are alternately above and below the pick. This method has the advantages of holding the pick in place and assuring that it is available next time the musician needs it. It also takes little room and the instrument will likely fit easily into its storage case without interference. The method requires no modification of the instrument or the strap. The disadvantages include distortion of the pick from having been held in a bent position for an extended period of time. Also, if the musician sometimes uses his fingers for striking or plucking the strings, the pick must be stored somewhere else and is again subject to being lost or misplaced. In addition, if the musician needs to have convenient accessibility to more than one pick, then the additional picks cannot be stored in the strings while the instrument is being played because it would prevent the strings from vibrating. If additional picks are stored in a musician's pocket, they are not easily visible and, when retrieved, time is spent sorting through all pocket contents or selecting the desired pick of several being stored.

There are many prior art references to devices that hold picks either on or near the musical instrument. Often, the pick holder is rigidly adhered to the musical instrument itself. U.S. Pat. No. 4,890,531 to Tischer (1990) describes a coil spring device that adheres to the surface of the instrument. The patent indicates that the spring is in slight tension and therefore reduces the compression that is needed to hold the picks tightly in the helical coils. The musician must put the picks under the coils for long term storage or when transporting. The device may prevent storing the guitar in its case because the pick holder could interfere with the closure of the lid. Adherence of the device to the sound board of a musical instrument has the potential to dampen the vibrations and therefore affect the tonal qualities. U.S. Pat. No. 7,847,171 to Kidd, III (2010) describes a coil spring device that attaches alternately to either the strings or to the tuning pegs of a guitar. When attached to the strings, the device may affect tuning, may rattle, and can come loose easily. Also it must be removed prior to storing the guitar in a protective case. U.S. Pat. No. 7,629,522 to Isaacson (2009) describes a device that is attached by means of adhesive and through a matching hole in the wall or soundboard of the guitar. This device also has the potential to distort the tonal qualities of the guitar. U.S. Pat. No. 8,097,799 to Tran (2012) describes a flexible slotted element that adheres to the bottom edge of a guitar. In this configuration the picks are not visible to the musician during a performance. In general, musicians tend to avoid attaching devices to the surfaces of musical instruments for the reasons indicated and because of the potential for marring or damage.

Sometimes the pick holder is designed for releasable attachment to the musical instrument. U.S. Pat. No. 3,752,029 to Watrous (1973) describes a device that is intended for mounting adjacent to the strings and on the surface of the musical instrument for use during a performance. This device and the picks would have to be stored and handled each time the instrument is used and does not serve the purpose preventing picks from being misplaced. U.S. Pat. No. 4,785,708 to Vaughan (1988) describes a flexible strip of pick holding pockets that is attached and released from the instrument with a hook-and-loop fastening system. Picks are not compressively held in the pockets and can therefore slide out unintentionally. These picks can get lost or will require time to retrieve. Also, the picks and the holder are not visible to the musician during performance. U.S. Pat. No. Des. 355,667 to Burger (1995) illustrates a spring shape that holds a plurality of picks. However, the dimensions must match the tuning keys of the musical instrument and therefore requires multiple sizes. It would tend to vibrate, making noise during performance. Also it must be detached prior to storing the guitar in its protective case, thus providing opportunity for misplacement or lose of the picks and the holder. U.S. Pat. No. 5,649,634 and U.S. Pat. No. 5,651,468 both to Irizarry (1997) describe an attachment and detachment device with a curved elongated helical coil to hold the picks. The opportunity for misplacement or lose is afforded due to the requirement for detaching any time the musical instrument is to be stored in a case. Attachment by suction cup to the musical instrument is likely to impact the tonal qualities due to dampening of vibrations. When picks are inserted in the helical wire form, they must extend into the inner portion of the curve because that is where the adjacent wires press together. If multiple picks are inserted, they tend to interfere with each other in the inner portion of the spring form, thus creating a practical limit to the number of picks that can be held. The spring form will easily move thus requiring two hands when inserting a pick, one for insertion and the other for holding the spring. U.S. Pat. No. Des. 393,362 to Byers (1998) illustrates a hanging pocket. Picks are not compressively held in the pocket and can therefore slide out unintentionally. These picks can get lost or will require time to retrieve. Also picks must be extracted sequentially so that it may take several extractions to find the preferred pick. Time must then be spent re-inserting the unwanted picks. U.S. Pat. No. 5,796,021 to Longshore (1998) describes a pick holder with releasable adhesive pads. The adhesive properties and thus the utility of the device tend to degrade with multiple attachments and detachments due to the accumulation of debris on the adhesive surface. The device must be detached to store the musical instrument in its case for traveling. Detachment affords the opportunity for accumulation of debris on the adhesive surface and for misplacement or lose of picks and the holder. U.S. Pat. No. 6,639,136 to Judd (2003) describes an elastomer device that attaches and detaches by inserting between the musical instrument strings and twisting. The instrument cannot be played while the device is attached because it prevents the strings from vibrating. When detached, the holder and the picks can be lost or misplaced. When attached, it interferes w/ storage in the instrument's protective case.

Sometimes the device is attached to the strap that musicians use for transferring the instrument's weight to the musician's shoulders and for positioning the instrument to play while standing. Attaching to and leaving the pick holder on the strap has the advantage of assuring that the picks are always accessible to the musician every time he attaches the strap to the instrument. When the pick holder grips the strap well, there is no possibility of misplacing or losing either the picks or the holder. The picks are easily visible and the device is within easy reaching distance to either insert the pick into the holder or extract from the holder. The musician typically stores the strap in empty cavities in the musical instrument's protective case, at the same time as storing the musical instrument, creating no interference with closure of the lid of the case. Often one end of the strap remains attached to the instrument. Therefore the pick, the pick holder, and the strap are always with the guitar.

The strap mounted pick holder in U.S. Pat. No. D309,674 to Gervase (1990) is subject to unintended sliding and change of position on the strap. Picks must be inserted and retrieved sequentially. The picks are bent slightly and may retain the distorted shape if left for extended periods. U.S. Pat. No. 5,299,485 to Denton (1994) describes a device that is complicated to manufacture and requires modifying the strap with holes to accommodate attachment screws. It cannot be quickly detached from the strap. U.S. Pat. No. 6,140,564 to Pia (2000) accommodates picks of a plurality of thicknesses but wide picks would overlap causing distortion and twisting that could reduce the holding effectiveness. Also, the holder would tend to slip and perhaps fall from the strap in the presence of flexing that normally occurs during performance and usage. The close arrangement of slots in U.S. Pat. No. 6,215,052 to Giddens and others (2001) makes it difficult to grasp and extract the preferred pick. Also thicker picks will be more difficult to insert and extract than thinner ones. The single sided clip with a single arm will allow twisting of the pick holder during insertion or extraction of picks.

Some pick holders are designed to attach to the microphone stand. These have the advantage of easy accessability to the performing muscian. U.S. Pat. No. 5,651,468 to Irizarry (1997) can mount on a microphone stand but requires both hands to operate and cannot alternatively be attached to the musical instrument's strap. U.S. Pat. No. 4,467,693 to Nasfell (1984) requires disassembly of the microphone stand and is partially focused on holding a multiple pick package of a specific design. Also, it cannot simultaneously accommodate individual picks of different thicknesses.

All inventions described above require either special tooling or multiple materials or multiple specialized manufacturing steps that are unique to the design.

OBJECTS AND ADVANTAGES

Accordingly, several objects and advantages of the present invention are:

(a) to provide an improved helical coil spring device for holding a plurality of musical instrument picks of varying thickness, widths and shapes;

(b) to provide two u-shaped arms that extend from the helical coil spring and either wrap around an edge or both edges and under a musical instrument strap, or wrap around the tubing of a microphone stand;

(c) to provide a slippage preventing cleat at the end of each u-shaped arm that either firmly presses against the strap without causing damage or presses against the edges of the strap;

(d) to provide a device w/ proper dimensions and angles such that when attached to a strap the u-shaped arms lie in a flat position against the strap;

(e) to provide a pick holder that does not distort the sound of the musical instrument;

(f) to provide a device that, when attached to a strap or microphone stand, increases the adjacent spring compressing force in the section of the helical coil farthest from the attachment and thereby increases the pick holding robustness;

(g) to provide a device that when attached to a strap or microphone stand, decreases the adjacent spring compressing force in the section of the helical coil nearest to the attachment and thereby enhances ease of pick insertion;

(h) to provide a pick holder that does not distort or bend the pick;

(i) to provide a device that is small enough that it is easily stored with the musical instrument inside the instrument's protective case;

(j) to provide a device that can be both easily attached to or detached from a musical instrument strap or microphone stand;

(k) to provide a device that can be attached to the strap alternately with u-shaped arms around the strap or by inserting the u-shaped arms of the device through a slot or hole in the strap;

(l) to provide a device that fits a wide variety of strap widths, styles, and thicknesses;

(m) to provide a pick holder that allows full pick visibility and easy pick accessibility by the musician while in performance;

(n) to provide a pick holder that does not require modification or disassembly of the strap or microphone stand for attachment or detachment;

(o) to provide a device that can be manufactured without the need for a plurality of materials, manufacturing steps, tooling, or processes;

(p) to provide a device that can be manufactured with common automated spring forming equipment.

Still further objects and advantages will become apparent from a consideration of the ensuing description and drawings.

SUMMARY

In accordance with the present invention a device that releasably grasps musical instrument picks and is strap or microphone stand attachable and detachable comprises a spring wire form with at least one helical coil section and having two u-shaped arms that each terminate with a cleat. Helical coil sections hold the picks. The two u-shaped arms wrap around an edge or edges of the strap. The cleats press against the underside of the strap to prevent pick holder slippage. The interaction of the arms and cleats with the strap modifies the compressive force distribution in the helical coil. The modified compressive force distribution enables easy insertion of the pick into one portion of the helical coil and increases the holding grip on the pick at a different portion of the helical coil. The interaction also modifies the angle of the arms, resulting in flat positioning of the pick holding device on the strap. When used on a microphone stand, the two u-shaped arms wrap around the stand's tubing. The resulting compressive force distribution is similar to that achieved on the strap.

DRAWINGS

Figures

In the drawings, closely related figures have the same number but different alphabetic suffices.

FIGS. 10C, 10D, 10E, and 10F show orthogonal top views of a pick holder with alternate helical coil configurations.

Figure 11A:
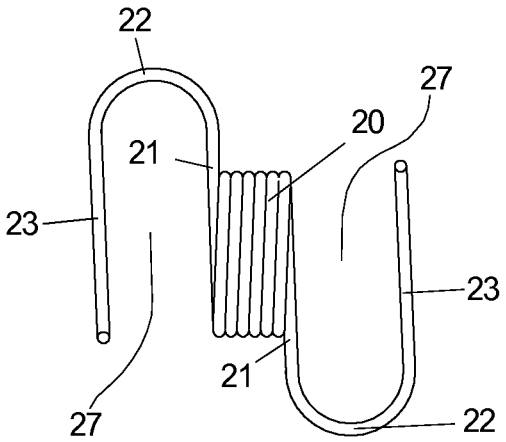
Figure 11B:
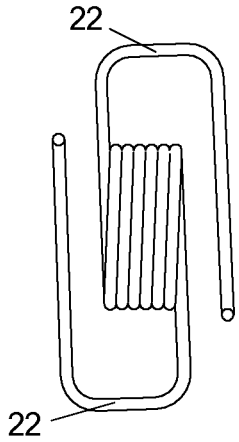

FIGS. 11A and 11B show an orthogonal top view of a pick holder with alternate u-shaped arm assembly bend configurations.

Figure 12:
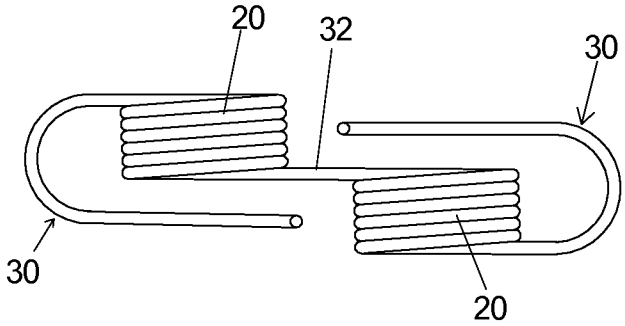

FIG. 12 shows an orthogonal top view of a pick holder with a plurality of helical coils.

Figure 13A:
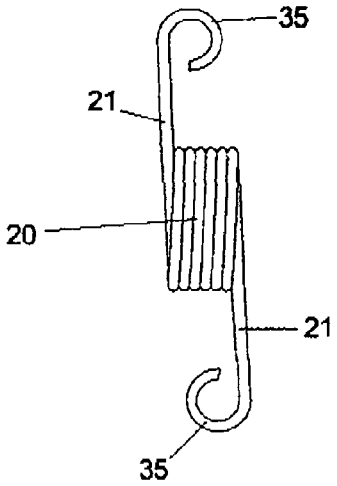

FIG. 13A shows orthogonal top view of a pick holder with an arm configuration indicating an alternative embodiment optimized for attaching through a strap button hole.

Figure 13B:
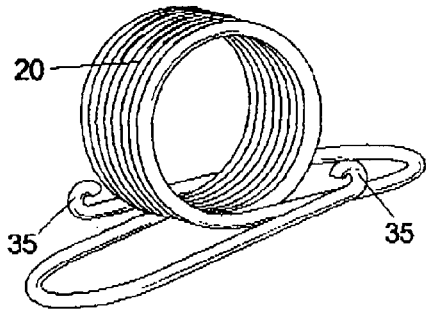

FIG. 13B shows a perspective view of the pick holder indicating an alternative embodiment with end loops terminating the u-shaped arms.

Figure 14A:
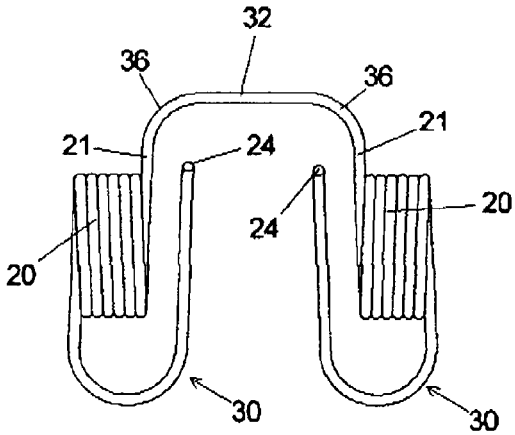
Figure 14B:
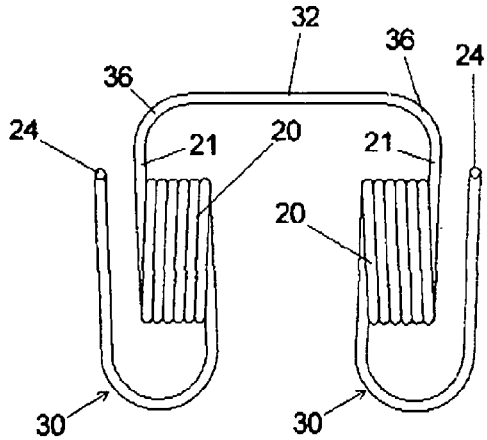

FIGS. 14A and 14B show orthogonal top views of a pick holder with alternate u-shaped arm configurations indicating an alternative embodiment for attaching to one side of a strap.

Figure 15A:
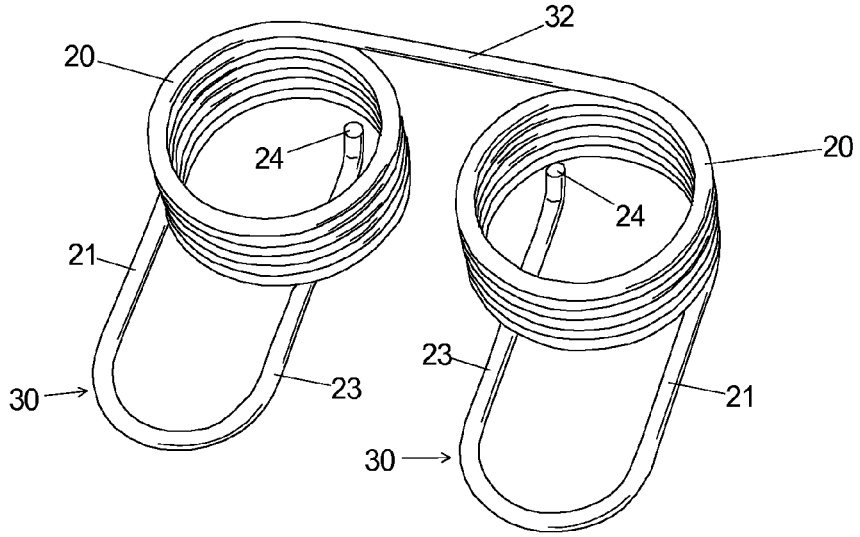

FIG. 15A shows a perspective view of a pick holder with an alternate helical coil orientation and u-shaped arms that attach to only one side of the strap.

Figure 15B:
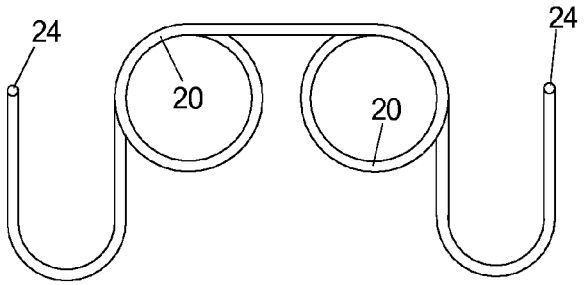
Figure 15C:
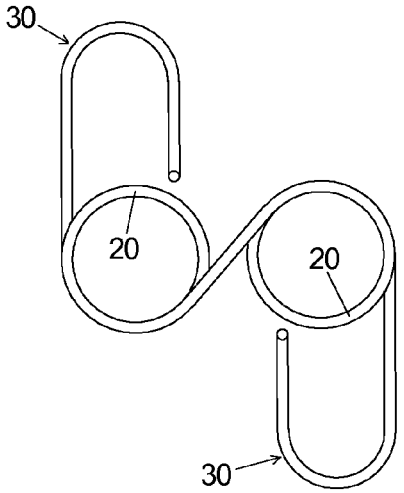

FIGS. 15B and 15C show orthogonal top views of a pick holder with an alternate helical coil connection strut orientations and with alternate u-shaped arm configurations.

Figure 16A:
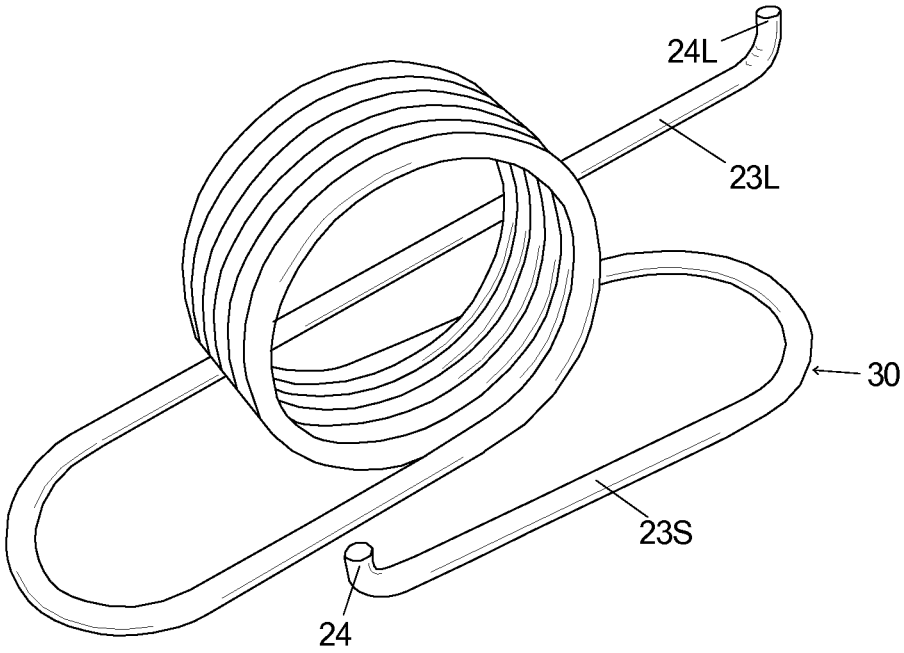
Figure 16B:
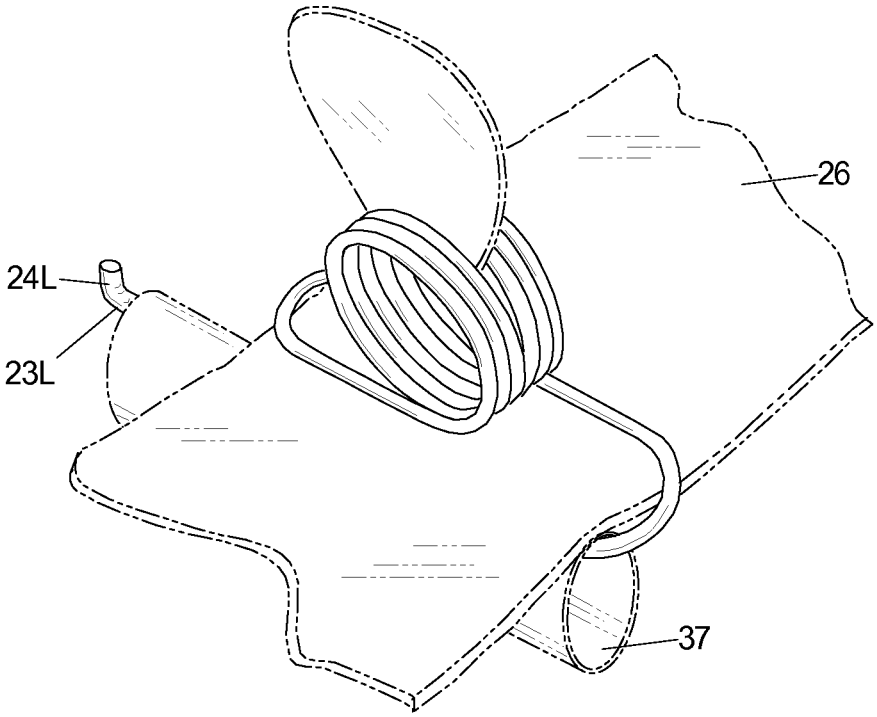

FIGS. 16A and 16B show perspective views of a pick holder with an alternate configuration for a cantilever strut for accommodating storage of a guitar slide.

DRAWINGS

Reference Numerals

Because the device is symmetrical, some parts of the device are identified by the same number to indicate an identical but oppositely formed component. Also, a part may be identified by number and a different alphabetic suffix when it appears in different orientations or is no longer symmetrical.

| | | | |
|---|---|---|---|
| 20 | Helical coil | 21 | Tangential extension |
| 22 | Arm loop | 23 | Cantilever strut |
| 24 | Cleat | 25 | Pick |
| 26 | Strap | 27 | Strap gap |
| 28 | Button hole | 29 | Pick holder and pick assembly |
| 30 | U-shaped arm assembly | 31 | Arm angle |
| 32 | Coil connection strut | 33 | Microphone stand tube |
| 34 | Pick insertion gap | 35 | End loop |
| 36 | Connection bend | 37 | Guitar slide |

DETAILED DESCRIPTION

Figure 1:
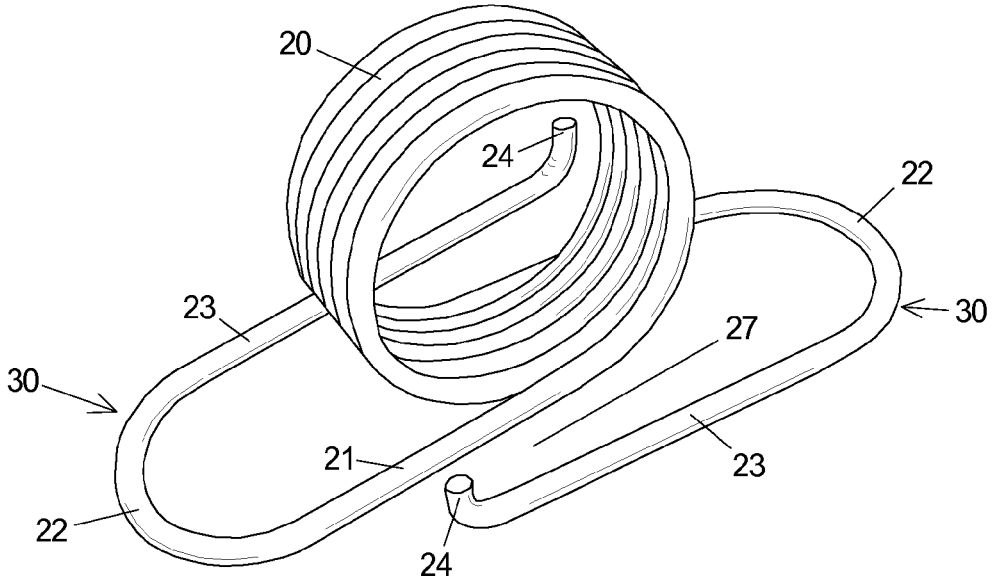
FIG. 1 shows a perspective view of the pick holder indicating its various functional parts.
Figure 3A:
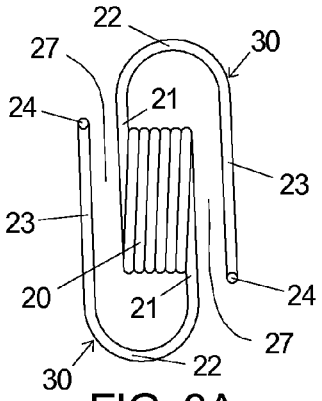
FIG. 3A shows an orthogonal top view of the pick holder in its relaxed unattached configuration.
Figure 3B:
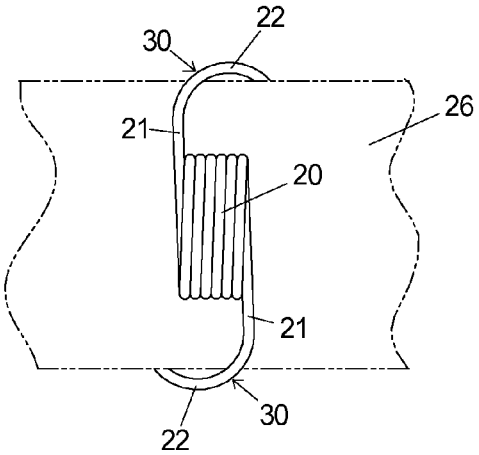
FIG. 3B shows an orthogonal top view of the pick holder attached to the strap indicating the position of the tangential extensions.
Figure 3C:
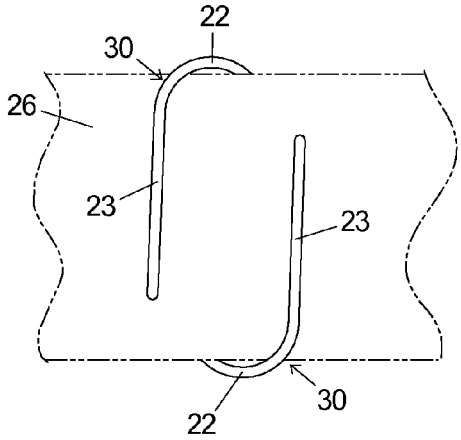
FIG. 3C shows an orthogonal bottom view of the pick holder attached to the strap indicating the position of the cantilever struts.
Figure 4A:
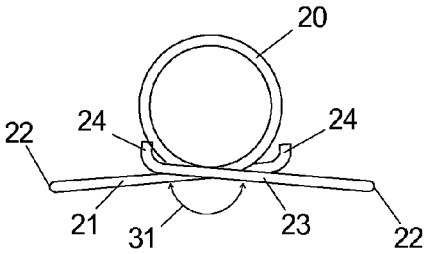
FIG. 4A shows an orthogonal side view of the pick holder in its relaxed unattached configuration showing the angle of the u-shaped arm extensions.
Figure 4B:
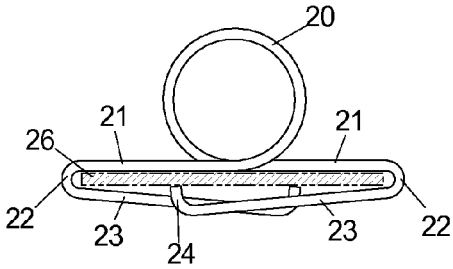
FIG. 4B shows an orthogonal side view of the pick holder in its strap attached configuration indicating the change in shape and the method of grasping the strap with cleats.
Figure 5A:
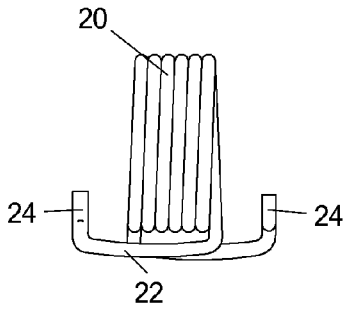
FIG. 5A shows an orthogonal end view of the pick holder in its relaxed unattached configuration.

Preferred Embodiment—FIGS. 1, 3, 4, 5, 10, 11A, 11B, and 16A A preferred embodiment of a pick holder of the present invention is illustrated in FIG. 1 (perspective view), FIG. 3A (orthogonal top view), FIG. 4A (orthogonal side view), and FIG. 5A (orthogonal end view).

The figures show a device having a helical coil 20 comprised of a plurality of substantially parallel circular loops of a shape resilient material of substantially circular cross section. These loops are helically displaced and adjacent loops generally touch. In the spring forming industry this shape is commonly referred to as a close wound coil. Referring to FIGS. 1 and 3A, extending from the helical coil 20 are two tangentially projecting members referred to as u-shaped arm assemblies 30. Both u-shaped arm assemblies 30 have substantially the same shape but are oppositely positioned and extend in generally opposite directions from the helical coil 20. Each u-shaped arm assembly 30 is comprised of four distinct components: a tangential extension 21, an arm loop 22, a cantilever strut 23, and a cleat 24. The device is formed from a single continuous length of the shape resilient material.

Figure 10A:
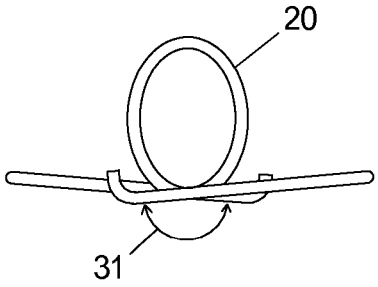
FIGS. 10A and 10B show orthogonal side views of a pick holder with alternate helical coil configurations and alternate u-shaped arm angles.
Figure 10B:
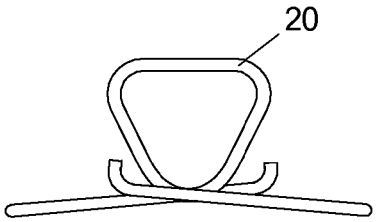
Figure 10C:
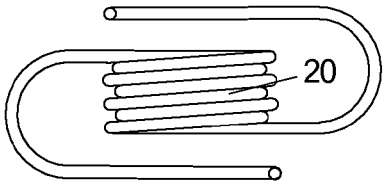
Figure 10D:
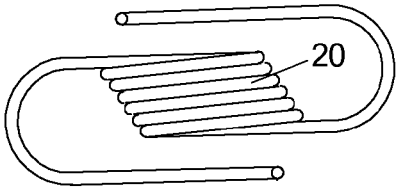

In the preferred embodiment, loops of the helical coil 20 have a generally circular shape with an inside diameter of roughly 20 mm. However, larger or smaller helical coil 20 diameters will work. Smaller diameters have the advantage of less material required for manufacture and therefore a lower cost. A larger diameter makes it easier to insert a plurality of picks into the pick holder because the compressive forces between loops are slightly lower. Also, with a larger diameter, the picks can be fanned out more, allowing more room for the musician's fingers to manipulate the pick during the insertion and extraction process. More fanning also makes it easier for the musician to see individual picks. Helical coil 20 loops do not have to be circular in shape and do not have to continuously touch. For instance, as shown in FIG. 10A, helical coil 20 loops can be elliptical. FIG. 10B shows triangular helical coil 20 loops. FIGS. 10C, and 10D show helical coil 20 loops offset slightly from the adjoining loop. Also, diameter could be changing from one loop to the adjoining one. Many other variations are obvious to those skilled in wire shaping.

Figure 10E:
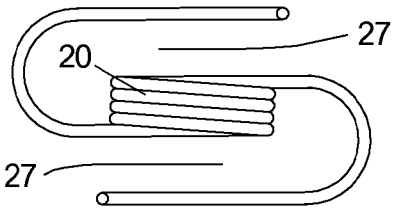
Figure 10F:
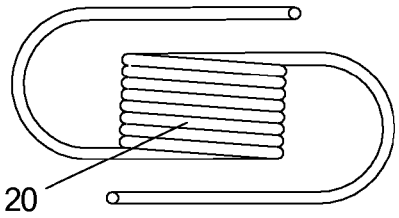

Referring to FIGS. 1 and 3A, tangential extensions 21 extend from both ends of the helical coil 20. Both tangential extensions 21 have substantially the same shape but are generally oppositely positioned and extend in substantially opposite directions from the helical coil 20. The two tangential extensions 21 form an arm angle 31 (FIG. 4A) of roughly 170 degrees when measured opposite the helical coil 20. The arm angle 31 can be different from 170 degrees as illustrated in FIG. 10A. Both tangential extensions 21 connect to an arm loop 22 (FIG. 1 and FIG. 3A). In the preferred embodiment, indicated in FIG. 3A, an arm loop 22 is a generally a semi-circular shape of approximately 180 degrees. However, the angle of the semi-circular shape can be greater or less than 180 degrees. An arm loop 22 does not have to follow a semi-circular shape. For instance, an arm loop 22 can be formed with two 90 degree bends (FIG. 11B) or three 60 degree bends, etc. In the preferred embodiment (FIGS. 1, 3A, and 4A) a plane that bisects the length of shape resilient material along the arm loop 22 and tangential extension 21 is substantially aligned parallel with the axis of the helical coil 20. However, other relative displacements of the helical coil 20 and u-shaped arm assemblies 30 will also work. As indicated in FIGS. 1 and 3A, each arm loop 22 connects to a cantilever strut 23. Cantilever struts 23 are displaced in a direction that is substantially parallel to the tangential extension 21 that is of the same u-shaped arm assembly 30. In the preferred embodiment, the tangential extension 21 and cantilever strut 23 that have a contiguous arm loop 22 are displaced on opposite sides of the helical coil 20 (FIG. 3A). However tangential extension 21 and cantilever strut 23 that have a contiguous arm loop 22 can be displaced on the same side of the helical coil 20 (FIG. 11A). In the preferred embodiment, the arm loop 22 has a radius sufficient to achieve a strap gap 27 (FIGS. 1 and 3A), located between the tangential extension 21 and the cantilever strut 23, of approximately 6.5 mm. However, as indicated in FIGS. 10E and 11A, the strap gap 27 can be adjusted to different dimensions. Referring to preferred embodiments FIGS. 1 and 3A, the distance from the inside of the arm loop 22 to the center of the axis of the helical coil 20 is roughly 27 mm. This 27 mm dimension is not required and may be adjusted to accommodate alternative embodiments. The end of each cantilever strut 23 is terminated with a cleat 24 (FIGS. 1, 3A, and 4A) which is formed by bending the shape resilient material in a direction that is generally toward the helical coil 20 and approximately 90 degrees to a plane formed through the arm loop 22, tangential extension 21, and cantilever strut 23. In the preferred embodiment, the shape resilient material bend has a roughly 2 mm radius and each cleat 24 has a length of roughly 3.7 mm. The bend radius can be larger or smaller. The cleat 24 length can be longer or shorter. As indicated in FIGS. 1, 3A, and 4A, in the preferred embodiment, the length of the cantilever strut 23 is sufficient to generally align the cleat 24 with a plane that is tangent to the circumference of the helical coil 20. However, as indicated in FIG. 16A, the lengths of the cantilever struts 23L and 23S can be longer or shorter.

In the preferred embodiment the shape resilient material of substantially circular cross section has a diameter of roughly 1.6 mm. However, the shape resilient material diameter can be larger or smaller and the cross section is not restricted to circular. The preferred diameter of the shape resilient material was determined by insertion of commercially available picks of thicknesses generally from 0.52 mm to 0.93 mm to validate functionality. Larger or smaller diameters may be appropriate for picks of different thickness.

In the preferred embodiment, the shape resilient material is a rust resistant spring steel such as stainless steel wire. However the material can be any that has, without fracturing or losing strength, long life shape resilience sufficient to repeatedly compressively hold and release a pick between the loops of the helical coil 20 and to continuously supply compressive force at the cleats 24 in a direction that is toward and generally normal to a strap on which it is affixed.

OPERATION

Figure 2:
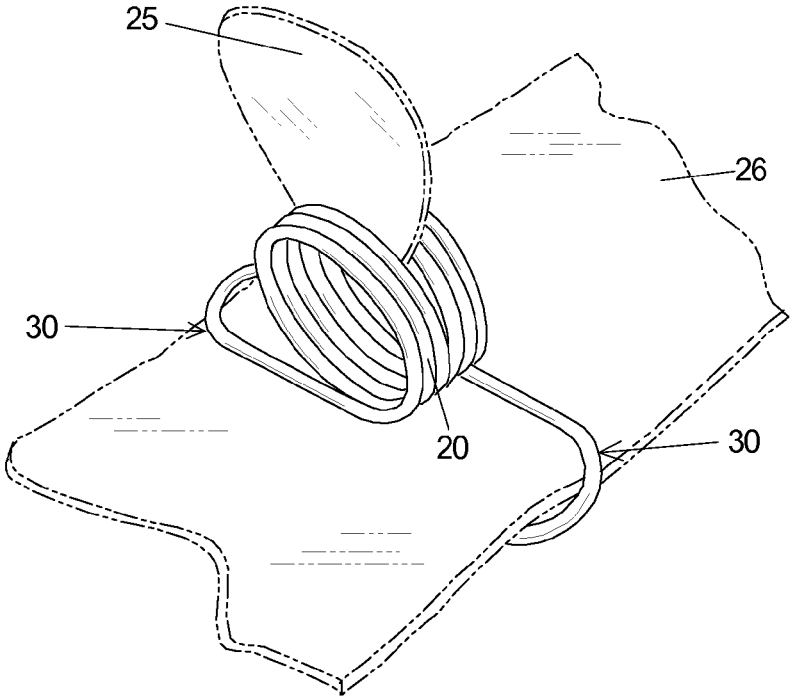
FIG. 2 shows a perspective view of the pick holder attached to a strap with u-shaped arms and holding a single pick indicating both strap attachment and pick holding functions.

Preferred Embodiment—FIGS. 2, 3A, 3B, 3C, 4A, 4B, 5A, 5B, 5C, 6, 7, 8, 9A, and 9B One use of the pick holder is illustrated in FIG. 2. The pick holder both attaches to a strap 26 and grips a pick 25 that has been inserted into the helical coil 20. The adjacent loops of the helical coil 20 compress against the pick 25, holding it in place until it is extracted by the musician. Although FIG. 2 shows only one pick 25, the pick holder can be used to hold a pick 25 between each set of adjacent loops of the helical coil 20. When a plurality of picks 25 are being gripped, any one pick 25 can be extracted while all others remain compressed in the loops. The picks 25 are not distorted or bent while being gripped by the helical coil 20. Also, the pick holder is useful for picks of any combination of sizes, shapes, or thicknesses.

FIGS. 2, 3B, and 3C illustrate the attachment of the pick holder to the strap 26. FIG. 3A shows a top view of the pick holder unattached to a strap. This view illustrates the strap gaps 27 between the tangential extensions 21 and the cantilever struts 23. The strap 26 fits through the strap gaps 27 and between the arm loops 22. FIGS. 2, 3B and 3C illustrate the u-shaped arm assemblies wrapping around both edges and underneath the strap 26. The helical coil 20 and the tangential extensions 21 are on one side of the strap 26 (FIG. 3B) and the cantilever struts 23 are on the other side of the strap 26 (FIG. 3C). The pick holder can be easily attached or detached from the strap 26.

FIGS. 4A and 4B illustrate the action of the cleats 24. The cleats 24 press against the underside of the strap 26 (FIG. 4B) to prevent slippage. The cleats 24 have a generally flat compressive surface that prevents penetration into and damage to the strap 26 but imparts sufficiently high force to embed the cleats 24 into the surface texture variations of strap 26. When attached to the strap 26, it stays in position, even when the strap 26 is relaxed as in storage. FIG. 4A shows a side view indicating the unattached position of the cleats 24, the tangential extension 21, and the cantilever strut 23. It shows the arm angle 31 of about 170 degrees. FIG. 4B shows the change in position of the cleats 24 and tangential extensions 21 and cantilever struts 23 when attached to the strap 26. The position when attached to strap 26 is generally flat, about 180 degrees, and the helical coil 20 is held against the strap 26. The cleats 24 have dual functions of gripping the strap 26 to prevent slippage and of pressing the strap 26 firmly against the helical coil 20 to add stability to the device so that the musician need use only one hand during pick insertion and extraction.

Figure 5B:
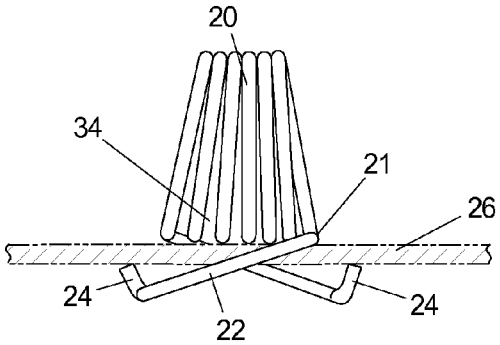
FIG. 5B shows an orthogonal end view of the pick holder indicating in exaggerated fashion the spreading or opening of adjacent wires in the helical coil when attached to a strap.

FIGS. 5A and 5B further illustrate the response of the pick holder when attached to the strap 26. The unattached pick holder is shown from an end view in FIG. 5A. It can be seen that in the free undistorted shape, the ends of the cleats 24 point up in a direction that is generally parallel with the loops of the helical coil 20. The arm loops 22 are substantially at 90 degrees to the loops of the helical coil 20. The displacement of the pick holder when mounted on a generally stiff strap 26 is illustrated and exaggerated for explanation in FIG. 5B. The cleats 24 are pushed against the strap 26 and are now angled by a few degrees with respect to the axis of the helical coil 20. The resulting angle causes one edge of the flat end of the cleats 24 to be slightly closer to the strap 26. The result is a tilted cleat 24 wherein one edge of the circular face presses with greater force in the strap 26. The edge of the circular face of the cleat 24 that is closer to the helical coil 20 embeds slightly deeper in the strap 26 than the edge on the opposite side of the same cleat 24. This results in a slightly tighter grip without penetration and defacement of the strap 26. The arm loops 22, when attached to the strap 26, are angled slightly down and away from the helical coil 20, becoming a lever that torsionally acts through the tangential extension 21. This torsional force is transmitted to the adjacent loops of the helical coil 20. If the strap 26 is stiff or thick, it causes the adjacent loops near the strap 26 to spread slightly, creating small pick insertion gaps 34, while simultaneously increasing compression between adjacent loops of the top of the helical coil 20. The adjacent loops of the helical coil 20 are no longer parallel. If the strap 26 is flexible, it reduces the compressive force between adjacent loops near the strap 26 without creating pick insertion gaps 34. With either a stiff or flexible strap 26, the result is an increase in compressive force between adjacent loops at the top, farthest from the strap 26.

Figure 5C:
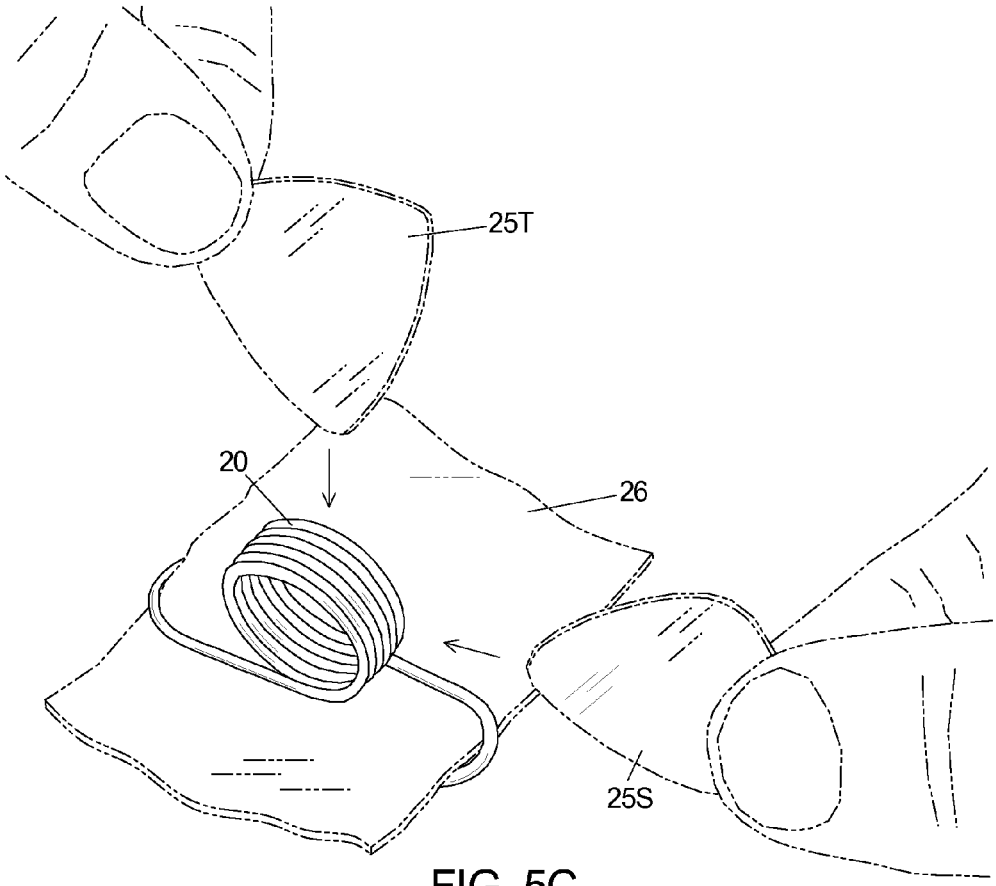
FIG. 5C shows a perspective view of picks being inserted from two different directions.

FIG. 5C illustrates top and side insertion of the pick. In FIG. 5C one pick 25T is shown being inserted into the helical coil 20 in a direction from the top of the pick holder. Another pick 25S is shown being inserted into the helical coil 20 from the side of the pick holder. The pick holder receives picks from either top or side. However, the side direction allows easier pick insertion due to reduced compressive forces or slight pick insertion gaps 34 (FIG. 5B) between the adjacent loops.

Figure 6A:
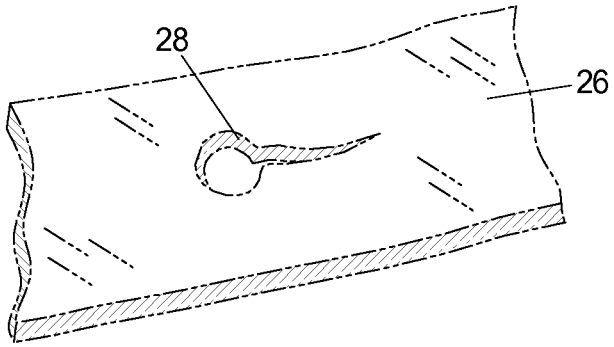
FIG. 6A shows a perspective view of a button hole that is a common feature on musical instrument straps.
Figure 6B:
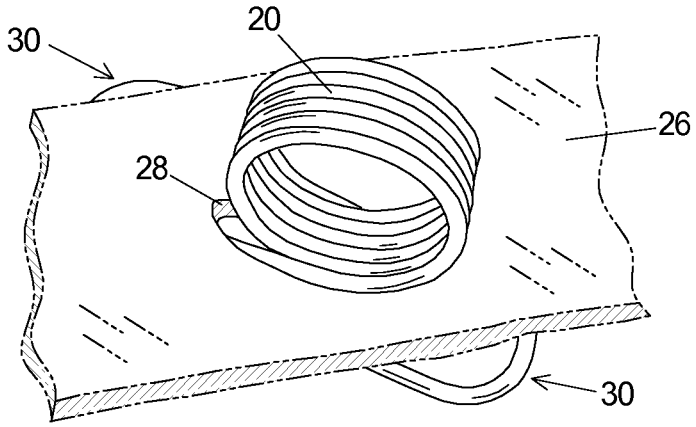
FIG. 6B shows a perspective topside view of a pick holder attached through a strap button hole.
Figure 6C:
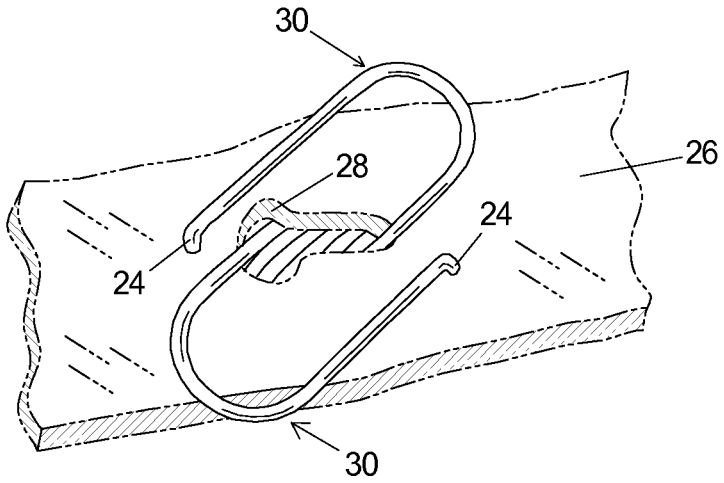
FIG. 6C shows a perspective underside view of a pick holder attached through a strap button hole.

FIG. 6A shows a perspective view of a button hole 28 through the strap 26. Button holes 28 in straps 26 typically fit on projections or "buttons" on the musical instrument for quick and easy strap 26 attachment and detachment. Sometimes the strap 26 has an unused button hole 28. Also, the button hole 28 can be added to the strap 26 if desired. Some straps 26 have a series of slots for adjusting the length of the strap 26. An unused slot can serve the same purpose as a button hole 28. The hole can be of a different shape and can be more than one. For example, two smaller holes that each accepts one u-shaped arm assembly 30 (FIG. 6B) would work. FIG. 6B shows a perspective view of the pick holder which is mounted through the button hole 28. The helical coil 20 rests against the strap 26. FIG. 6C shows a perspective view of the other side of the strap 26 illustrating how the u-shaped arm assemblies 30 extend through the button hole 28 and the cleats 24 press against the strap. The pick holder always remains tightly gripped on the strap 26 but is easily removable if the musician desires. When the strap 26 is attached to the musical instrument, the pick holder is easily seen and reached by the musician. A plurality of picks are tightly gripped. Picks are easily individually inserted, selected, or removed.

Figure 7:
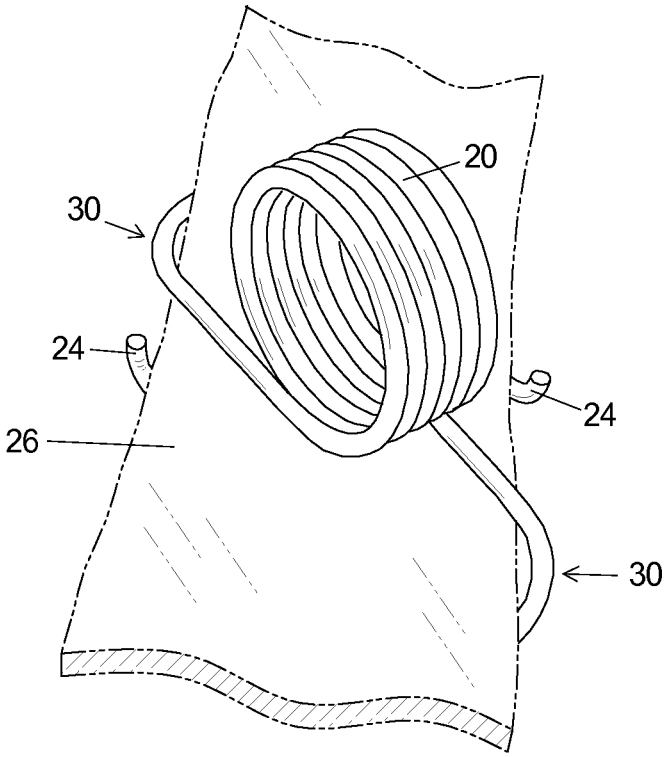
FIG. 7 shows a perspective top view of a pick holder attached to a narrow strap.

FIG. 7 is a perspective view that illustrates mounting the pick holder of preferred embodiment on a narrow strap 26. Note that cleats 24 do not press against the underside of the narrow strap 26. Instead they extend on the sides of the strap 26. In this position, they act as clamp faces, pressing against the edges of the strap 26, to help hold the pick holder in place. The helical coil 20 is held in correct position, pressing against the strap 26. The u-shaped arm assemblies 30 shift from the angled position of FIG. 4A to a generally flat position. When cleats 22 press against the edges of the strap 26, the objectives and advantages of the pick holder are still intact. The pick holder will hold a plurality of picks of many different sizes and thicknesses. It will remain on the strap in the position that the musician places it.

Figure 8:
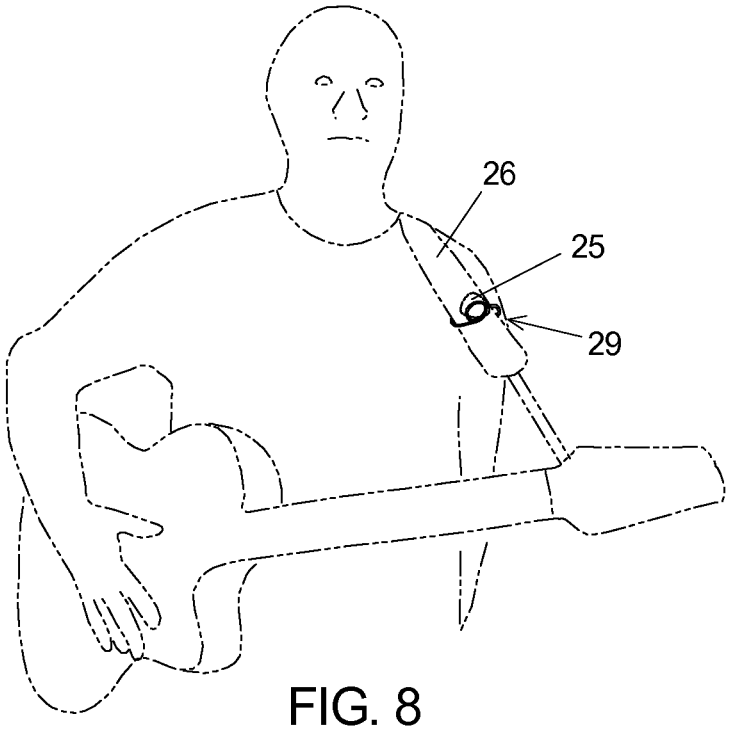
FIG. 8 shows a perspective view of the pick holder grasping a pick and attached on a musical instrument strap showing visibility and accessibility.

FIG. 8 illustrates the functional convenience of the pick holder when attached to the strap 26. The pick holder and pick assembly 29 are visible and within easy reach of the musician when attached to the strap 26. Alternatively, when the strap 26 is stored with the pick holder still attached, the pick 25 remains in the holder and is always in a predictable location and is immediately available without separate effort by the musician.

Figure 9A:
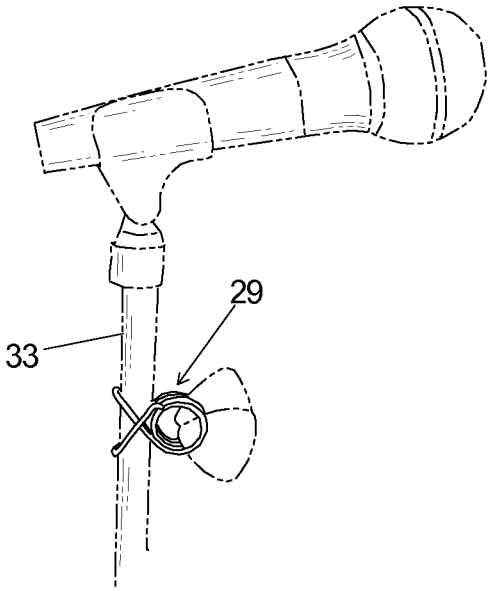
FIG. 9A shows a perspective view of a pick holder mounted on a microphone stand indicating visibility and accessibility by a musician.
Figure 9B:
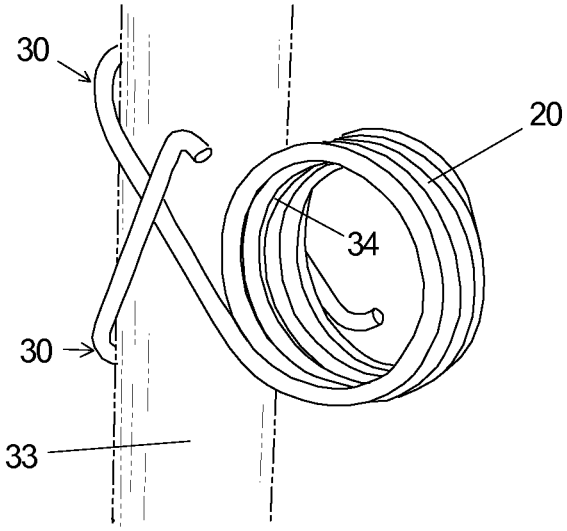
FIG. 9B shows a perspective view of a pick holder mounted on the microphone stand indicating how the arm loops wrap around the cylindrical tube.

FIGS. 9A and 9B are perspective views that illustrate mounting the pick holder of preferred embodiment on a microphone stand tube 33. FIG. 9A shows the pick holder and pick assembly 29 mounted on the microphone stand tube 33. FIG. 9B shows that the u-shaped arms 30 wrap around and frictionally grasp the cylindrical shape of the microphone stand tube 33. The loops of the helical coil 20 are displaced as previously indicated. Adjacent circular loops of the helical coil 20 are no longer parallel. Circular loops nearest to the stand separate slightly to create the pick insertion gap 34 that enhances the ease of pick insertion from the sides, using only one hand. Circular loops farthest from the stand are compressed toward each other to enhance the pick holding force. Accordingly, the objectives and advantages of the pick holder are preserved when attached to a microphone stand. The pick holder will hold a plurality of picks of many different sizes and thicknesses. It will remain on the microphone stand in the position that the musician places it. As illustrated in FIG. 9A, full visibility and easy reach functionality of the pick holder are also preserved when attached to microphone stand.

DESCRIPTION

Alternative Embodiment Number 1—FIG. 12

Generally, alternative embodiments are variations on the elements of the preferred embodiment. The alternative embodiment shown in top view in FIG. 12 is comprised of a coil connection strut 32 connected to adjacent helical coils 20. Each helical coil is connected to a single u-shaped arm assembly 30. The central axis of the helical coils 20 are parallel but are separated by a distance greater than the average outside diameter of the helical coils 20. The helical coils 20 can be different diameters. The entire assembly is formed from a single continuous length of shape resilient material.

OPERATION

Alternative Embodiment Number 1—FIG. 12

Operation of the alternative embodiment, shown in orthogonal top view in FIG. 12, is the same as the preferred embodiment with the following exceptions. As a result of the coil connection strut 32 connecting adjacent helical coils 20 and the pick holder having more than one helical coil 20 the length of the device is increased, allowing it to fit on wider straps and increasing the number of picks that can be stored in the device. Helical coils 20 may have different diameters to enhance marketing based on perceived fitness for various pick sizes. This embodiment retains all the objectives and advantages of the preferred embodiment.

DESCRIPTION

Alternative Embodiment Number 2—FIGS. 13A and 13B

FIG. 13A shows an orthogonal top view of an alternative embodiment of the pick holder comprised of a helical coil 20, tangential extensions 21, and end loops 35. FIG. 13B shows a perspective view of a pick holder with end loops 35 instead of cleats 24. Some preferred embodiment elements are removed and one additional element, an end loop 35, is added. The end loop 35 extends from the outermost end of the shape resilient material in a circular form of about 270 degrees. The entire assembly is formed from a single continuous length of shape resilient material.

OPERATION

Alternative Embodiment Number 2—FIGS. 13A and 13B

Operation of the additional embodiment of FIG. 13A is the same as the preferred embodiment with the following exceptions. Detachably gripping the strap 26 with arms can be done only through a button hole 28. Also, this embodiment will not attach to a microphone stand tube 33. The advantage is that it requires less material to manufacture. Operation of the additional embodiment of FIG. 13B is the same as the preferred embodiment. The advantage is that it allows attaching to a strap 26 of loosely woven fabric without penetration through the strap of the cleat 24. Otherwise both alternative embodiments retain all the objectives and advantages of the preferred embodiment.

DESCRIPTION

Alternative Embodiment Number 3—FIGS. 14*a* and 14*b*

FIGS. 14A and 14B show orthogonal top views of an alternative embodiment that includes the coil connection strut 32 of FIG. 12. In this embodiment, the helical coils 20 have generally the same central axis. However, they could each have different central axis. The coil connection strut 32 is contiguous at each end with a connection bend 36. A tangential extension 21 of each helical coil 20 is contiguous with one of the connection bends 36. FIG. 14A has connection bends 36 contiguous with tangential extensions 21 of the inside faces of helical coils 20 and the u-shaped arm assemblies 30 terminate between two helical coils 20. FIG. 14B has connection bends 36 contiguous with tangential extensions 21 of the helical coils 20 at the outside face and the u-shaped arm assemblies 30 terminate outside the two helical coils 20. Other embodiments are possible to one who is knowledgeable in the art of wire forming. An example is a device formed with one u-shaped arm assembly 30 terminating between the helical coils 20 and the other u-shaped arm assembly 30 terminating outside the helical coils 20. The entire assembly is formed from a single continuous length of shape resilient material.

OPERATION

Alternative Embodiment Number 3—FIGS. 14A and 14B

Operation of the additional embodiment is the same as preferred embodiment with the following exceptions. The alternative embodiment shown in FIGS. 14A and 14B allows attachment on a single edge of the strap to accommodate wider straps. It includes two helical coils 20 and thereby increases the number of picks that can be stored in the device. This embodiment retains all the objectives and advantages of the preferred embodiment except the ability to attach to a microphone stand tube and the ability to attach through a button hole. The embodiment of FIG. 14A will use less of the shape resilient material than the embodiment of FIG. 14B. However, greater distance between cleats 24 in FIG. 14B provides greater stability during the insertion and extraction of picks. The entire assembly is formed from a single continuous length of shape resilient material.

DESCRIPTION

Alternative Embodiment Number 4—FIGS. 15A, 15B, and 15C

FIG. 15A shows a perspective view and FIGS. 15B and 15C show orthogonal top views of alternate embodiments of a pick holder. It is similar to FIGS. 14A and 14B with the following exceptions. Referring to FIG. 15A, each helical coil 20 has a central axis which is generally perpendicular to the strap surface. In addition, the distance between the non-coincident axis of each helical coil 20 is generally greater than the average of the outside diameters of the two helical coils 20. The two helical coils 20 can be different diameters. The u-shaped arm assemblies 30 are oriented such that a line perpendicular to an imaginary plane that generally bisects both tangential extensions 21 and cantilever struts 23 is also generally parallel to the central axis of both helical coils 20. FIG. 15A shows a perspective view wherein the cleats 24 project up through the helical coils 20. FIG. 15B shows an orthogonal top view wherein the cleats 24 are outside of the helical coils 20. FIG. 15C shows an orthogonal top view of the alternative embodiment with u-shaped arm assemblies 30 extending in generally opposite directions from the helical coils 20.

OPERATION

Alternative Embodiment Number 4—FIGS. 15A, 15B, and 15C

Operation of the additional embodiment is the same as preferred embodiment with the following exceptions. Picks are inserted and held in a plane that is generally parallel to the strap. The configuration indicated in FIGS. 15A and 15B removably attaches to only one edge of the strap. This embodiment retains all the objectives and advantages of the preferred embodiment except the ability to attach to a microphone stand and to attach through a strap button hole.

DESCRIPTION

Alternative Embodiment Number 5—FIGS. 16A and 16B

FIGS. 16A and 16B show perspective views of an alternate embodiment of the pick holder where one of the cantilever struts 23L is longer than the preferred embodiment cantilever strut 23S. One cantilever strut 23S presses against the strap as described previously. The other cantilever strut 23L is of sufficient length to extend through a hollow cylindrical guitar slide 37.

OPERATION

Alternative Embodiment Number 5—FIGS. 16A and 16B

Operation of the additional embodiment is the same as preferred embodiment with the following exceptions. The cleat 24L on the longer cantilever strut 23L allows convenient retention and extraction of a guitar slide 37. The guitar slide 37 is a hollow cylindrical or tubular device sometimes used by a guitarist to change tones by pressing it against strings instead of pressing strings against frets on the neck of the guitar. The guitar slide 37 is securely retained by inserting the cantilever strut 23L through the hollow cylindrical shape of the guitar slide 37. The guitar slide 37 is thus springily held against the strap 26. The cleat 24L acts as a retainer to prevent the guitar slide 37 from falling off the pick holder device. The position retention and firmness of gripping the strap is retained by the one cleat 24 and u-shaped arm assembly 30 of the preferred embodiment.

CONCLUSION, RAMIFICATIONS, AND SCOPE

Accordingly the reader will see that the pick holder of this invention provides a highly reliable, easy to manufacture, economical, and convenient device for both releasably gripping one or a plurality of musical instrument picks and for detachably gripping a musical instrument strap or a microphone stand. The device prevents misplacement of picks and provides for their convenient visual accessibility during use of the musical instrument. It can grip many styles, thicknesses, and shapes of both picks and musical instrument straps. The device, with or without picks, is conveniently stored with the musical instrument and, because it is attached to the strap, has no effect on tonal qualities. In addition, the device prevents pick shape distortion.

While the above description contains many specificities, these should not be construed as limitations on the scope of the invention, but as exemplifications of the presently preferred embodiments thereof. Many other ramifications and variations are possible within the teachings of the invention. For example, the shape resilient material can have a larger or smaller diameter or a cross-section shape different than circular; the tangential extension can be longer or shorter or non-symmetrical and can be at a different angle; the u-shaped arm bend can have some other configuration than a circular arc and can be other than parallel to the helical coil axis; the cantilever strut can have a plurality of lengths and can be other than parallel to the tangential extension; the cleat can be of different lengths and different angles and can be pointed or missing; the device can be fabricated in colors; it can be constructed from sub-assemblies; the shape resilient material can be plastic or elastomeric and can be molded; the configuration can distribute compression forces with greater force near the strap and lesser force away from the strap, making it easier to insert the pick from the top; the distance between adjacent helical coils can be adjusted to compressively hold other items such as cigarettes. Any combination of the elements described or shown can be combined.

Also, even though the device is conceived as a holder of picks, it can functionally hold other items useful to the musician. Examples include but are not limited to sheet music, a list of song chords, or stage notes. Also the device can be used as an attachment point for stage display such as, but not limited to, streamers, trinkets, or flowers. In addition, the device may also serve as an attachment point for a pocket or bag to temporarily hold valuables that the musician may desire not to leave back-stage during a performance. Also, the device can be attached to other straps such as those attached to a canvas musical instrument case or other bags that have a generally flat strap.

While the device was conceived as peripheral to musical instruments, it can also be useful for non-musical purposes. For instance, it can be easily affixed to straps of back-packs and used as an attachment point for carrying supplies or equipment for school or hiking trips, as examples. When detached from the backpack, the same device can be used with light cord as a grappling hook. The device can also removeably attach to tree limbs to serve as temporary and non-damaging attachment points for camping equipment such as lanterns or cords. Also, the device can be affixed to belts for the attachment of tools, key rings, etc.

Thus the scope of the invention should be determined by the appended claims and their legal equivalents, and not by the examples given.

I claim:

1. A method of providing for a musician convenient storage, visual accessibility, easy insertion, enhanced gripping, and easy removal of a single or a plurality of picks, comprising:

(a) providing a close wound helical coil or coils each having a plurality of generally adjacent loops formed from a single elongated shape resilient element having a predetermined cross-sectional shape, and (b) providing two u-shaped arms contiguous with said coils and formed from said elongated element, and (c) providing rotational displacement of said u-shaped arms when said u-shaped arms are attached to a strap or cylindrical shape wherein said rotational displacement torsionally urges said helical coil, and (d) providing, as a result of said torsional urging, a gradient of separation displacement around the periphery and between said adjacent loops wherein said displacement changes from a maximum, in one portion of said loops, to zero displacement in portions of the periphery that are diametrically opposite said maximum displacement, and (e) providing reduced urging force between said adjacent loops in portions where said displacement is maximum thereby increasing insertion ease of said picks between said adjacent loops, and (f) providing increased compressive urging between said adjacent loops in portions where said displacement is zero wherein said picks are more strongly gripped for storage, whereby attachment to a strap or cylindrical object using said u-shaped arms provides rotational torque means to predictably redistribute compression forces around the periphery of said adjacent loops of said helical coil providing insertion ease of said picks in one portion and enhanced gripping of said picks in another portion of said helical coil or coils.

2. The method of claim 1 further providing cleats of said elongated material that contiguously terminate said u-shaped arms wherein localized springly urging of said cleats against said strap prevents slippage when said picks are inserted and removed from said helical coils.

3. The method of claim 2 further providing one of said u-shaped arms of sufficient length to extend through a hollow cylindrical musical instrument slide, whereby said cleat of said elongated arm provides a stop to prevent said slide from slipping from said strap.

4. A device that can releasably grasp flat planar forms and detachably grip a strap or cylindrical shape comprising:

(a) at least one helical coil of a shape resilient element, (b) said shape resilient element being of a predetermined cross-sectional shape, (c) said helical coil being a plurality of adjacent generally circular loops, (d) said circular loops formed such that adjacent loops generally touch or have generally close proximity, (e) tangential extensions of said shape resilient element from different ends of said helical coil, (f) said tangential extensions extending in generally opposite directions and at an angle slightly more or less than 90 degrees when measured from a common plane formed through the axis of said helical coil, (g) said helical coil and said tangential extensions formed from a single continuous length of said shape resilient element.

5. The gripping device of claim 4 further including:

(h) a generally semi-circular bend formed at the end of said tangential extensions from said continuous length of said shape resilient element, (i) a cantilevered strut extending from each said bend and made from said continuous length of said shape resilient element.

6. The gripping device of claim 5 wherein:

(j) said strut is generally parallel to said tangential extension when they have a contiguous said semi-circular bend, (k) a plane formed through each contiguous said tangential extension, said semi-circular bend, and said strut is generally parallel to the axis of said helical coil, (l) said helical coil is located generally between said struts, (m) said strut length is approximately equal to the length of said tangential extension plus the radius of said helical coil.

7. The gripping device of claim 6 further including:

(n) two cleats, (o) said cleats being a contiguous extension of each said cantilever strut, (p) said cleats being of said continuous length of said shape resilient element, (q) said cleats being formed with a bend that is generally 90 degrees to each said plane through each contiguous said tangential extension, said semi-circular bend, and said cantilever strut, (r) said cleats being displaced such that they protrude from said planes in a direction toward said helical coil.

8. A device for receiving and releasably gripping flat planar objects, and for attaching to a strap comprising:

(a) an elongated shape resilient element having a predetermined cross-sectional shape, and (b) one or a plurality of close wound helical coils each having a plurality of generally adjacent loops formed from a portion of said shape resilient element, and (c) two tangentially projecting generally u-shaped arms formed from a portion of said shape resilient element and extending from said helical coil or coils, whereby entire said device is formed from a single said elongated shape resilient element and said u-shaped arms springly attach to said strap and torsionally distort said close wound helical coils to produce separate and predictable insertion and gripping zones for said flat planer objects.

9. The device of claim 8 further including a cleat formed from a portion of said elongated element disposed at the terminus of each said u-shaped arm.

10. The device of claim 9 wherein said cleat terminates with a generally planar surface that is substantially perpendicular to the axis of said elongated element.

11. The device of claim 9 wherein said cleat is comprised of an end loop.

12. The device of claim 8 further including a coil connection strut between each of a plurality of said close wound coils formed from a portion of said elongated element.

13. The device of claim 12 wherein a plane generally parallel to each said u-shaped arm is disposed substantially parallel to the axis of said helical coil or said plurality of helical coils.

14. The device of claim 12 wherein a plane generally parallel to both said u-shaped arms is disposed substantially perpendicular to the axis of said helical coil or said plurality of helical coils.

* * * * *